US011530822B2

(12) United States Patent
Shaffer

(10) Patent No.: US 11,530,822 B2
(45) Date of Patent: Dec. 20, 2022

(54) SYSTEM AND METHOD FOR GENERATING WHITE NOISE USING A PACKAGED TERMINAL AIR CONDITIONER UNIT

(71) Applicant: Haier US Appliance Solutions, Inc., Wilmington, DE (US)

(72) Inventor: Timothy Scott Shaffer, La Grange, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 526 days.

(21) Appl. No.: 16/568,454

(22) Filed: Sep. 12, 2019

(65) Prior Publication Data

US 2021/0080126 A1 Mar. 18, 2021

(51) Int. Cl.

| | |
|---|---|
| ***F24F 1/40*** | (2011.01) |
| ***F24F 1/027*** | (2019.01) |
| ***F24F 13/24*** | (2006.01) |

(52) U.S. Cl.

CPC ..... *F24F 1/40* (2013.01); *F24F 1/027* (2013.01); *F24F 13/24* (2013.01); *F24F 2013/245* (2013.01); *F24F 2013/247* (2013.01)

(58) Field of Classification Search

CPC .... F24F 1/40; F24F 1/027; F24F 13/24; F24F 2013/247

See application file for complete search history.

(56) References Cited

U.S. PATENT DOCUMENTS

2012/0324928 A1* 12/2012 Durham ..... G05B 13/0205 96/397
2014/0348666 A1* 11/2014 Bonham ..... F04D 25/0693 417/44.11
2016/0238263 A1* 8/2016 Meissner ..... F04D 29/663
2020/0340698 A1* 10/2020 Ben-Gal Nguyen .... F24F 11/38

FOREIGN PATENT DOCUMENTS

CN 105299828 A 2/2016
JP 2005180842 A 7/2005
KR 101870414 B1 * 6/2018 ..... F24F 1/40

OTHER PUBLICATIONS

KR-101870414 English Translation (Year: 2018).*
Friedrich, Packaged Terminal Air Conditioners, https://www.goedekers.com/assets/PDF/Friedrich/pdh15k5sg-brochure.pdf, 10 pages.

* cited by examiner

*Primary Examiner* — David J Teitelbaum
(74) *Attorney, Agent, or Firm* — Dority & Manning, P.A.

(57) ABSTRACT

A packaged terminal air conditioner unit (PTAC) includes a bulkhead that defines an indoor portion and an outdoor portion. An outdoor fan is positioned within the outdoor portion and a controller is communicatively coupled with the outdoor fan for receiving a command to generate white noise and operating the outdoor fan to create the white noise at a desired decibel level to block out ambient sounds. A user may regulate the outdoor fan speed when the PTAC is not heating or cooling by setting a desired decibel level, e.g., using a control panel of the PTAC.

18 Claims, 10 Drawing Sheets

SYSTEM AND METHOD FOR GENERATING WHITE NOISE USING A PACKAGED TERMINAL AIR CONDITIONER UNIT

FIELD OF THE INVENTION

The present disclosure relates generally to air conditioner units, and more particularly to methods for generating white noise using packaged terminal air conditioner units.

BACKGROUND OF THE INVENTION

Air conditioner or conditioning units are conventionally utilized to adjust the temperature indoors—i.e. within structures such as dwellings and office buildings. Such units commonly include a closed refrigeration loop to heat or cool the indoor air. Typically, the indoor air is recirculated while being heated or cooled. A variety of sizes and configurations are available for such air conditioner units. For example, some units may have one portion installed within the indoors that is connected, by e.g., tubing carrying the refrigerant, to another portion located outdoors. These types of units are typically used for conditioning the air in larger spaces.

Another type of unit, sometimes referred to as a packaged terminal air conditioner unit (PTAC), may be used for somewhat smaller indoor spaces that are to be air conditioned. These units may include both an indoor portion and an outdoor portion separated by a bulkhead and may be installed in windows or positioned within an opening of an exterior wall of a building. PTACs typically include an indoor fan positioned within the indoor portion for circulating air through an indoor heat exchanger and an outdoor fan positioned within the outdoor portion for circulating air through an outdoor heat exchanger.

One benefit of a packaged terminal air conditioner unit is its ability to generate noise within a room, e.g., to drown out other ambient noises. For example, a hotel may have many sources of loud noises which might disturb room occupants. Certain PTACs permit users to turn the indoor fan on even when the sealed system is not operating to generate noise. However, in certain circumstances, operating the indoor fan may generate undesirable air currents within the room.

Accordingly, improved air conditioner units and features for generating white noise would be useful. More specifically, packaged terminal air conditioner units for generating white noise independent of the indoor fan would be particularly beneficial.

BRIEF DESCRIPTION OF THE INVENTION

Aspects and advantages of the invention will be set forth in part in the following description, or may be apparent from the description, or may be learned through practice of the invention.

In accordance with one embodiment, an air conditioner unit is provided including a bulkhead defining an indoor portion and an outdoor portion and an outdoor fan positioned within the outdoor portion for urging a flow of air through the outdoor portion. A controller is communicatively coupled with the outdoor fan for receiving a command to generate white noise and operating the outdoor fan to generate the white noise.

In accordance with another embodiment, a method of generating white noise using an outdoor fan of a packaged terminal air conditioner unit is provided. The method includes receiving a command to generate the white noise and operating the outdoor fan to generate the white noise.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
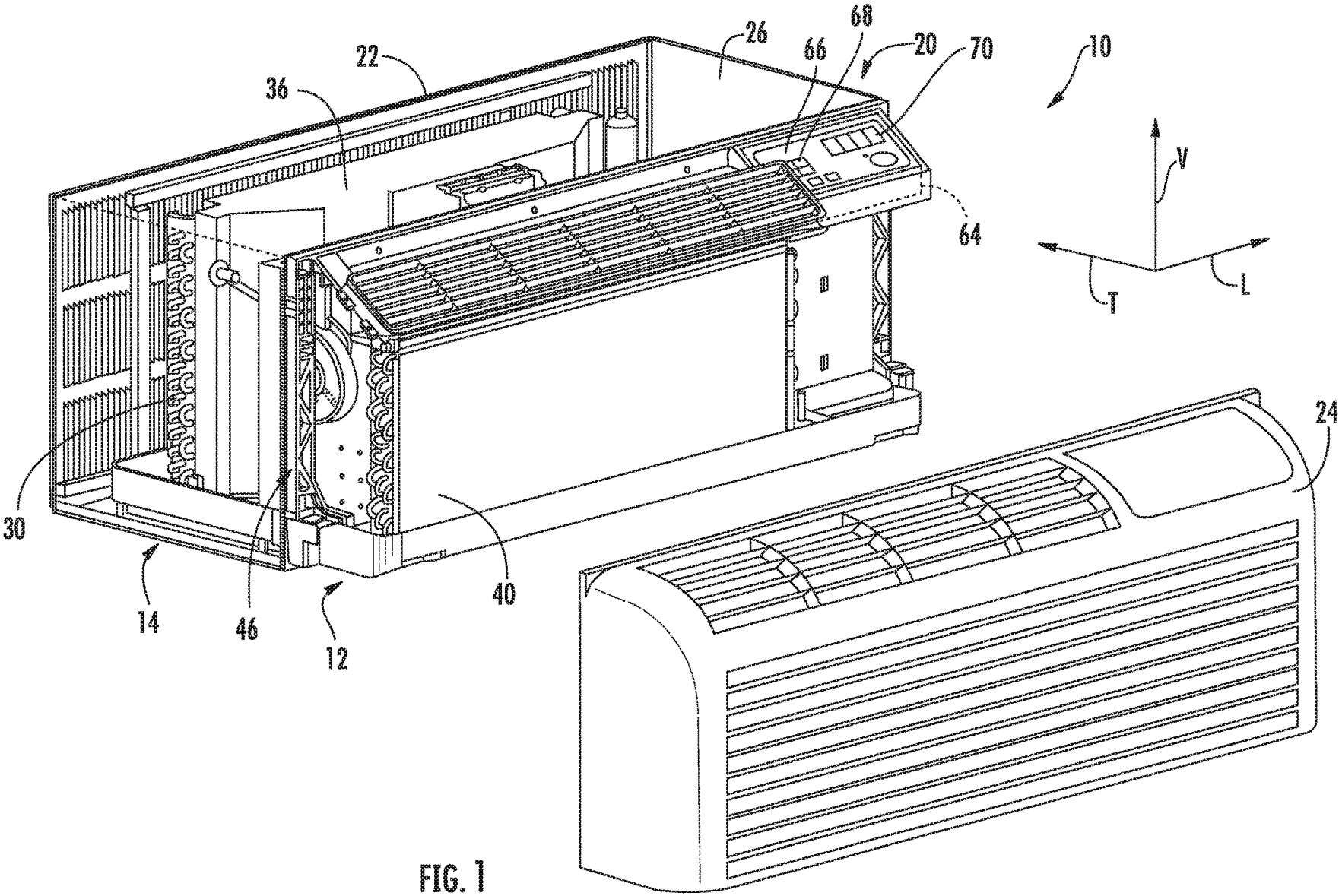
FIG. 1 provides a perspective view of an air conditioner unit, with part of an indoor portion exploded from a remainder of the air conditioner unit for illustrative purposes, in accordance with one exemplary embodiment of the present disclosure.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows and "downstream" refers to the direction to which the fluid flows. In addition, terms of approximation, such as "approximately," "substantially," or "about," refer to being within a ten percent margin of error.

Referring now to FIG. 1, an air conditioner unit 10 is provided. The air conditioner unit 10 is a one-unit type air conditioner, also conventionally referred to as a room air conditioner or a packaged terminal air conditioner (PTAC). The unit 10 includes an indoor portion 12 and an outdoor portion 14, and generally defines a vertical direction V, a lateral direction L, and a transverse direction T. Each direction V, L, T is perpendicular to each other, such that an orthogonal coordinate system is generally defined.

A housing 20 of the unit 10 may contain various other components of the unit 10. Housing 20 may include, for example, a rear grill 22 and a room front 24 which may be spaced apart along the transverse direction T by a wall sleeve 26. The rear grill 22 may be part of the outdoor portion 14, and the room front 24 may be part of the indoor portion 12. Components of the outdoor portion 14, such as an outdoor heat exchanger 30, an outdoor fan 32 (FIG. 2), and a compressor 34 (FIG. 2) may be housed within the wall sleeve 26. A casing 36 may additionally enclose outdoor fan 32, as shown.

Figure 2:
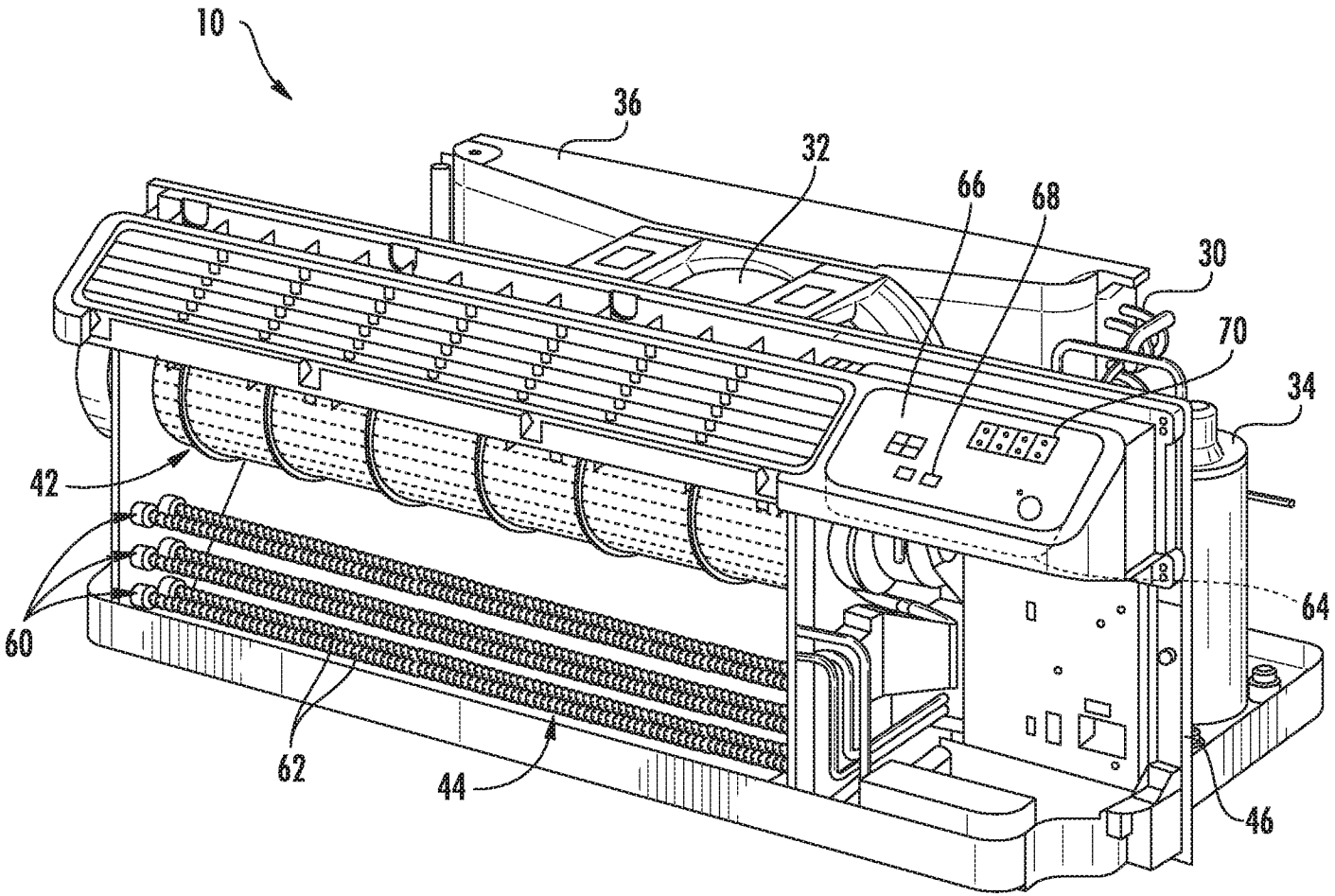
FIG. 2 is another perspective view of components of the indoor portion of the exemplary air conditioner unit of FIG. 1.

Referring now also to FIG. 2, indoor portion 12 may include, for example, an indoor heat exchanger 40 (FIG. 1), a blower fan 42, and a heating unit 44. These components may, for example, be housed behind the room front 24. Additionally, a bulkhead 46 may generally support and/or house various other components or portions thereof of the indoor portion 12, such as the blower fan 42 and the heating unit 44. Bulkhead 46 may generally separate and define the indoor portion 12 and outdoor portion 14.

Figure 3:
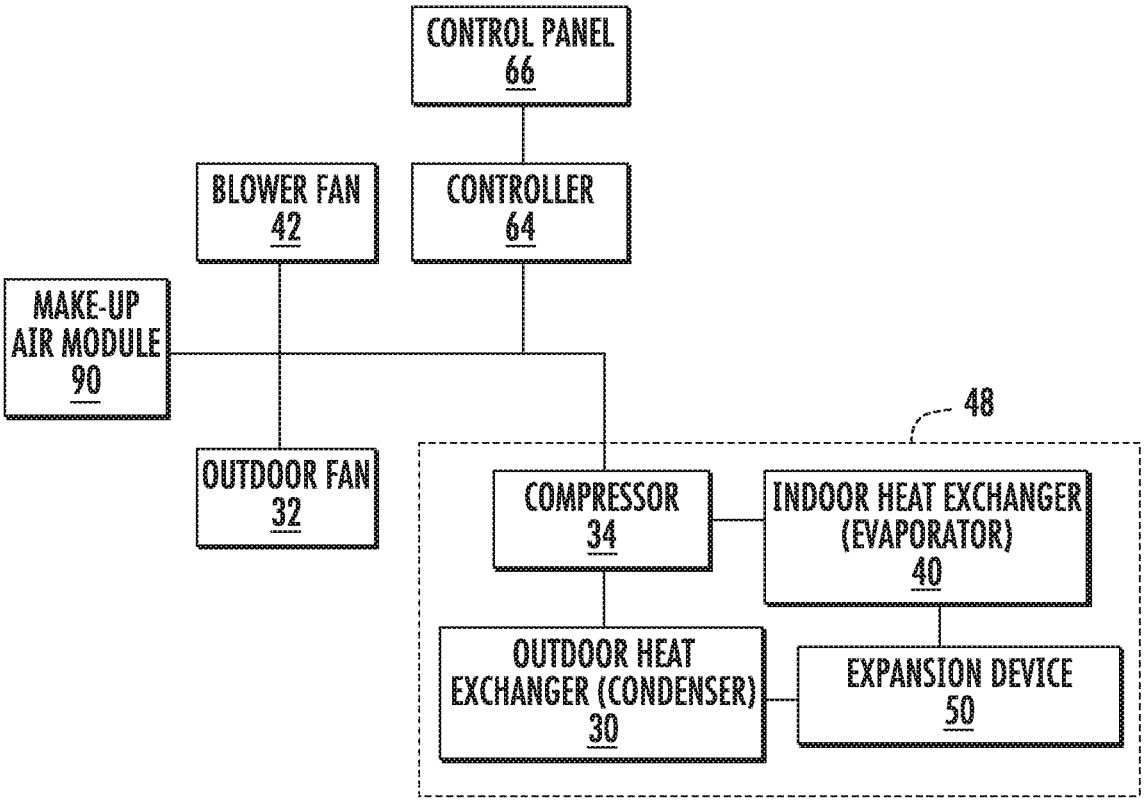
FIG. 3 is a schematic view of a refrigeration loop in accordance with one embodiment of the present disclosure.

Outdoor and indoor heat exchangers 30, 40 may be components of a refrigeration loop 48, which is shown schematically in FIG. 3. Refrigeration loop 48 may, for example, further include compressor 34 and an expansion device 50. As illustrated, compressor 34 and expansion device 50 may be in fluid communication with outdoor heat exchanger 30 and indoor heat exchanger 40 to flow refrigerant therethrough as is generally understood. More particularly, refrigeration loop 48 may include various lines for flowing refrigerant between the various components of refrigeration loop 48, thus providing the fluid communication there between. Refrigerant may thus flow through such lines from indoor heat exchanger 40 to compressor 34, from compressor 34 to outdoor heat exchanger 30, from outdoor heat exchanger 30 to expansion device 50, and from expansion device 50 to indoor heat exchanger 40. The refrigerant may generally undergo phase changes associated with a refrigeration cycle as it flows to and through these various components, as is generally understood. Suitable refrigerants for use in refrigeration loop 48 may include pentafluoroethane, difluoromethane, or a mixture such as R410a, although it should be understood that the present disclosure is not limited to such example and rather that any suitable refrigerant may be utilized.

As is understood in the art, refrigeration loop 48 may be alternately be operated as a refrigeration assembly (and thus perform a refrigeration cycle) or a heat pump (and thus perform a heat pump cycle). As shown in FIG. 3, when refrigeration loop 48 is operating in a cooling mode and thus performs a refrigeration cycle, the indoor heat exchanger 40 acts as an evaporator and the outdoor heat exchanger 30 acts as a condenser. Alternatively, when the assembly is operating in a heating mode and thus performs a heat pump cycle, the indoor heat exchanger 40 acts as a condenser and the outdoor heat exchanger 30 acts as an evaporator. The outdoor and indoor heat exchangers 30, 40 may each include coils through which a refrigerant may flow for heat exchange purposes, as is generally understood.

According to an example embodiment of the present subject matter, compressor 34 is a single speed compressor configured for operating at a desirable rated operating speed. However, it should be appreciated that according to alternative embodiments, compressor 34 may be a variable speed compressor. In this regard, compressor 34 may be operated at various speeds depending on the current air conditioning needs of the room and the demand from refrigeration loop 48. For example, according to an exemplary embodiment, compressor 34 may be configured to operate at any speed between a minimum speed, e.g., 1500 revolutions per minute (RPM), to a maximum rated speed, e.g., 3500 RPM. Notably, use of variable speed compressor 34 enables efficient operation of refrigeration loop 48 (and thus air conditioner unit 10), minimizes unnecessary noise when compressor 34 does not need to operate at full speed, and ensures a comfortable environment within the room.

In exemplary embodiments as illustrated, expansion device 50 may be disposed in the outdoor portion 14 between the indoor heat exchanger 40 and the outdoor heat exchanger 30. According to the exemplary embodiment, expansion device 50 may be a capillary tube or another suitable expansion device configured for use in a thermodynamic cycle. However, according to alternative embodiments, expansion device may be an electronic expansion valve that enables controlled expansion of refrigerant, as is known in the art. In this regard, electronic expansion device 50 may be configured to precisely control the expansion of the refrigerant to maintain, for example, a desired temperature differential of the refrigerant across the indoor heat exchanger 40. In other words, electronic expansion device 50 throttles the flow of refrigerant based on the reaction of the temperature differential across indoor heat exchanger 40 or the amount of superheat temperature differential, thereby ensuring that the refrigerant is in the gaseous state entering compressor 34.

According to the illustrated exemplary embodiment, outdoor fan 32 is an axial fan and indoor blower fan 42 is a centrifugal fan. However, it should be appreciated that according to alternative embodiments, outdoor fan 32 and blower fan 42 may be any suitable fan type. In addition, according to an exemplary embodiment, outdoor fan 32 and blower fan 42 are variable speed fans. For example, outdoor fan 32 and blower fan 42 may rotate at different rotational speeds, thereby generating different air flow rates. It may be desirable to operate fans 32, 42 at less than their maximum rated speed to ensure safe and proper operation of refrigeration loop 48 at less than its maximum rated speed, e.g., to reduce noise when full speed operation is not needed. In addition, according to alternative embodiments, fans 32, 42 may be operated to urge make-up air into the room.

According to the illustrated embodiment, blower fan 42 may operate as an evaporator fan in refrigeration loop 48 to encourage the flow of air through indoor heat exchanger 40. Accordingly, blower fan 42 may be positioned downstream of indoor heat exchanger 40 along the flow direction of indoor air and downstream of heating unit 44. Alternatively, blower fan 42 may be positioned upstream of indoor heat exchanger 40 along the flow direction of indoor air, and may operate to push air through indoor heat exchanger 40.

Heating unit 44 in exemplary embodiments includes one or more heater banks 60. Each heater bank 60 may be operated as desired to produce heat. In some embodiments as shown, three heater banks 60 may be utilized. Alternatively, however, any suitable number of heater banks 60 may be utilized. Each heater bank 60 may further include at least one heater coil or coil pass 62, such as in exemplary embodiments two heater coils or coil passes 62. Alternatively, other suitable heating elements may be utilized.

The operation of air conditioner unit 10 including compressor 34 (and thus refrigeration loop 48 generally) blower fan 42, outdoor fan 32, heating unit 44, expansion device 50, and other components of refrigeration loop 48 may be controlled by a processing device such as a controller 64. Controller 64 may be in communication (via for example a suitable wired or wireless connection) to such components of the air conditioner unit 10. Controller 64 may include a memory and one or more processing devices such as microprocessors, CPUs or the like, such as general or special purpose microprocessors operable to execute programming instructions or micro-control code associated with operation of unit 10. The memory may represent random access memory such as DRAM, or read only memory such as ROM or FLASH. In one embodiment, the processor executes programming instructions stored in memory. The memory may be a separate component from the processor or may be included onboard within the processor.

Unit 10 may additionally include a control panel 66 and one or more user inputs 68, which may be included in control panel 66. The user inputs 68 may be in communication with the controller 64. A user of the unit 10 may interact with the user inputs 68 to operate the unit 10, and user commands may be transmitted between the user inputs 68 and controller 64 to facilitate operation of the unit 10 based on such user commands. A display 70 may additionally be provided in the control panel 66, and may be in communication with the controller 64. Display 70 may, for example be a touchscreen or other text-readable display screen, or alternatively may simply be a light that can be activated and deactivated as required to provide an indication of, for example, an event or setting for the unit 10.

Figure 4:
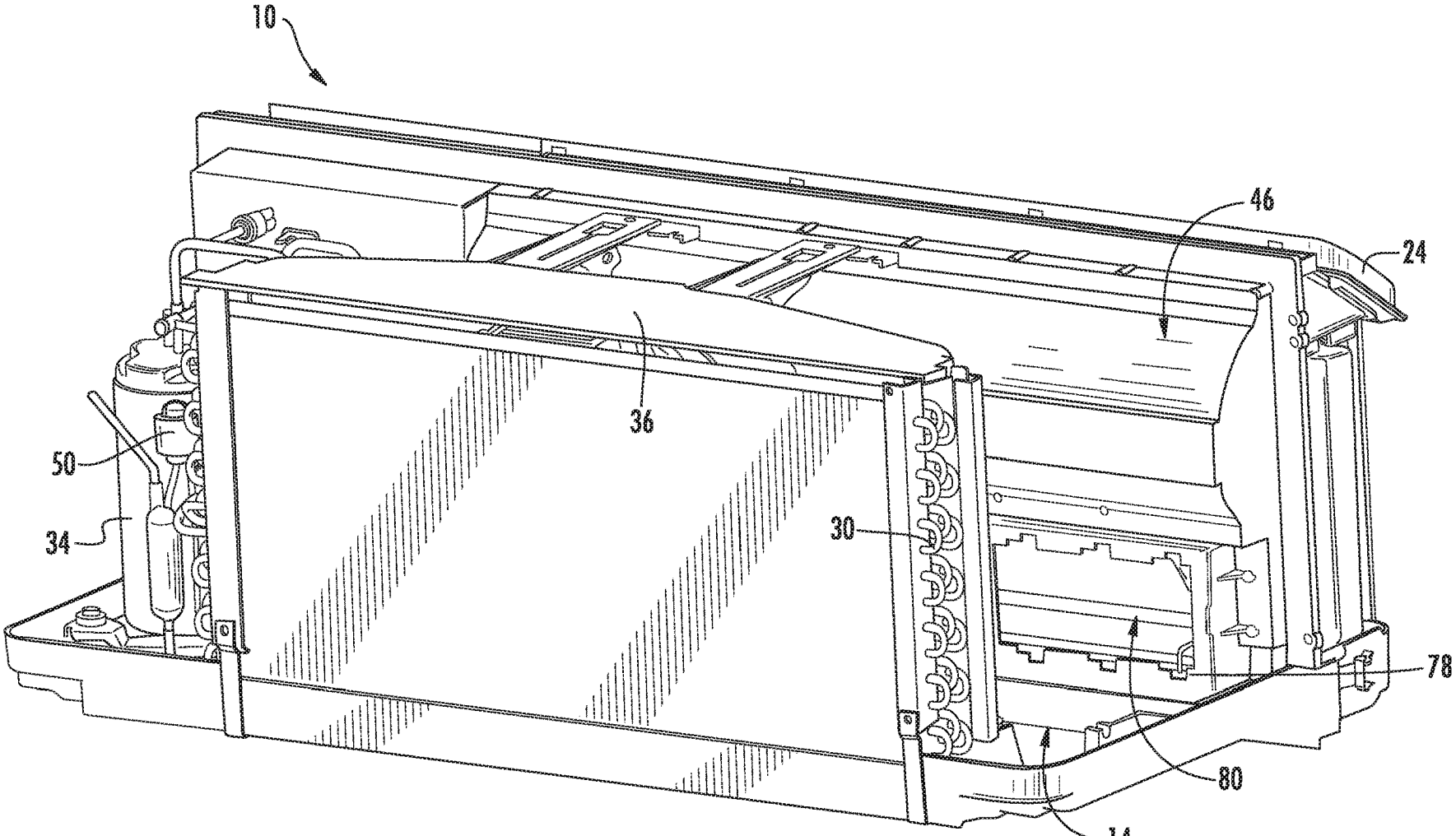
FIG. 4 is a rear perspective view of an outdoor portion of the exemplary air conditioner unit of FIG. 1, illustrating a vent aperture in a bulkhead assembly in accordance with one embodiment of the present disclosure.

Referring briefly to FIG. 4, bulkhead 46 may include define a door frame 78 that surrounds and defines a vent aperture 80 for providing fluid communication between indoor portion 12 and outdoor portion 14. Vent aperture 80 may be utilized in an installed air conditioner unit 10 to allow outdoor air to flow into the room through the indoor portion 12. In this regard, in some cases it may be desirable to allow outside air (i.e., "make-up air") to flow into the room in order, e.g., to meet government regulations, or to compensate for negative pressure created within the room. In this manner, according to an exemplary embodiment, make-up air may be provided into the room through vent aperture 80 when desired.

Figure 5:
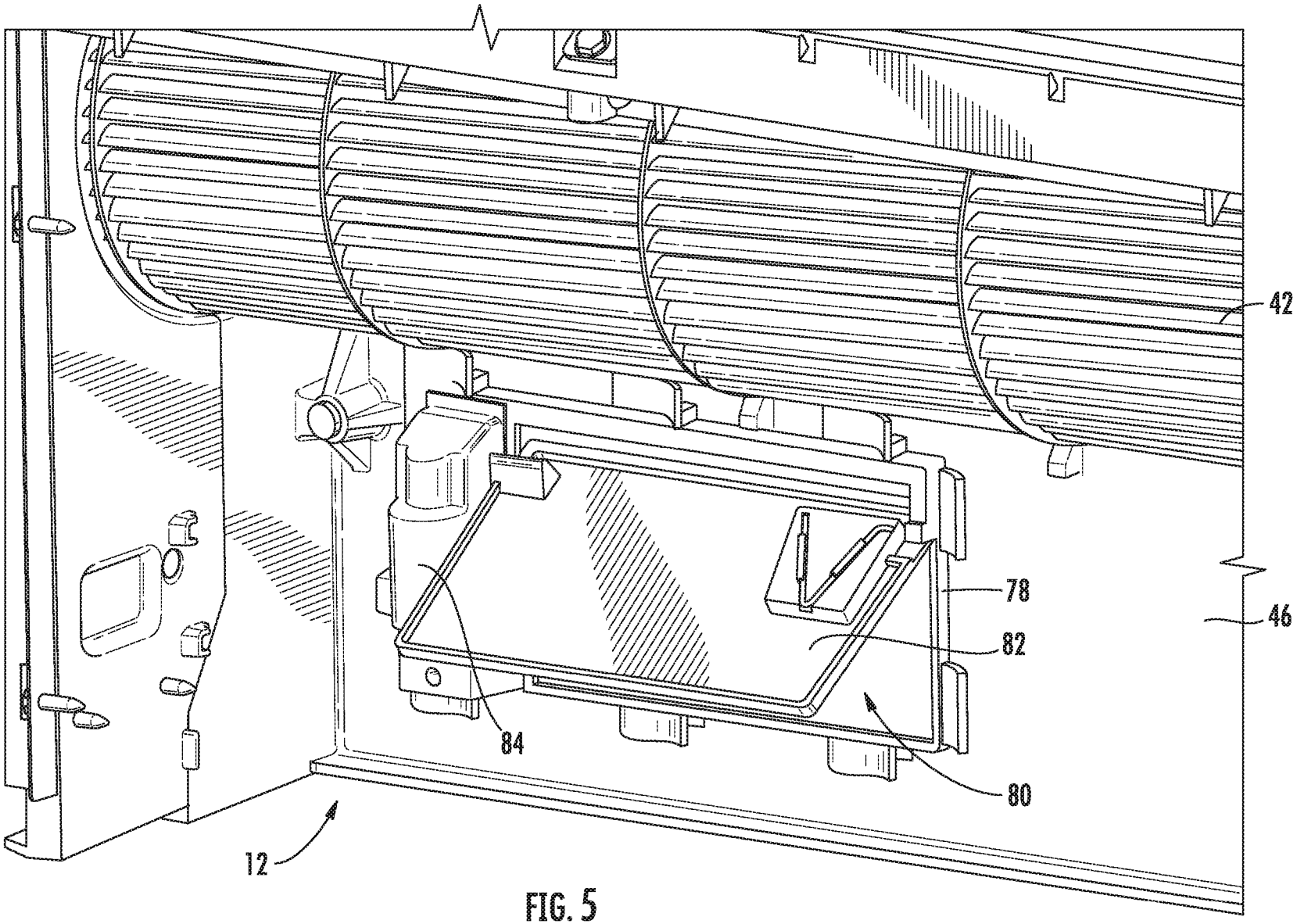
FIG. 5 is a front perspective view of the exemplary bulkhead assembly of FIG. 4 with a vent door illustrated in the open position in accordance with one embodiment of the present disclosure.

As shown in FIG. 5, a vent door 82 may be pivotally mounted to the bulkhead 46 (e.g., directly to door frame 78) proximate to vent aperture 80 to open and close vent aperture 80. More specifically, as illustrated, vent door 82 is pivotally mounted to the indoor facing surface of indoor portion 12. Vent door 82 may be configured to pivot between a first, closed position where vent door 82 prevents air from flowing between outdoor portion 14 and indoor portion 12, and a second, open position where vent door 82 is in an open position (as shown in FIG. 5) and allows make-up air to flow into the room. According to the illustrated embodiment vent door 82 may be pivoted between the open and closed position by an electric motor 84 controlled by controller 64, or by any other suitable method.

Figure 6:
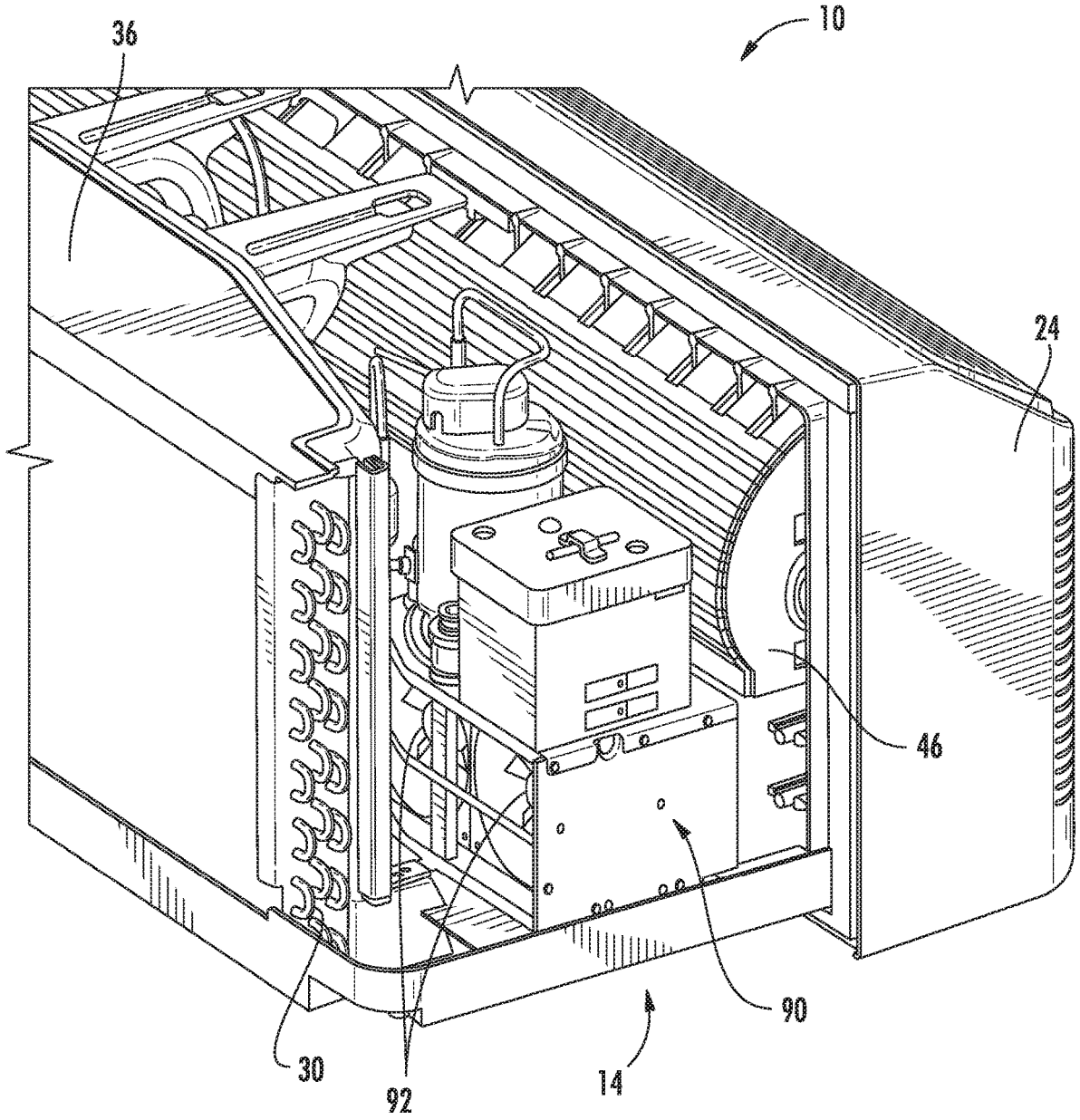
FIG. 6 is a rear perspective view of the exemplary air conditioner unit and bulkhead assembly of FIG. 4 including a sealed system for conditioning make-up air in accordance with one embodiment of the present disclosure.

In some cases, it may be desirable to treat or condition make-up air flowing through vent aperture 80 prior to blowing it into the room. For example, outdoor air which has a relatively high humidity level may require treating before passing into the room. In addition, if the outdoor air is cool, it may be desirable to heat the air before blowing it into the room. Therefore, as illustrated in FIG. 6, unit 10 may further include an auxiliary sealed system, or make-up air module 90, for conditioning make-up air. As shown, make-up air module 90 and/or an auxiliary fan 92 are positioned within outdoor portion 14 adjacent vent aperture 80 and vent door 82 is positioned within indoor portion 12 over vent aperture 80, though other configurations are possible. According to the illustrated embodiment auxiliary sealed system 90 may be controlled by controller 64, by another dedicated controller, or by any other suitable method.

As illustrated, make-up air module 90 includes auxiliary fan 92 that is configured as part of auxiliary sealed system 90 and may be configured for urging a flow of air (not shown) through auxiliary sealed system 90. Auxiliary sealed system 90 may further includes one or more compressors, heat exchangers, and any other components suitable for operating auxiliary sealed system 90 similar to refrigeration loop 48 described above to condition make-up air. For example, auxiliary system 90 can be operated in a dehumidification mode, an air conditioning mode, a heating mode, a fan only mode where only auxiliary fan 92 is operated to supply outdoor air, an idle mode, etc.

Figure 7:
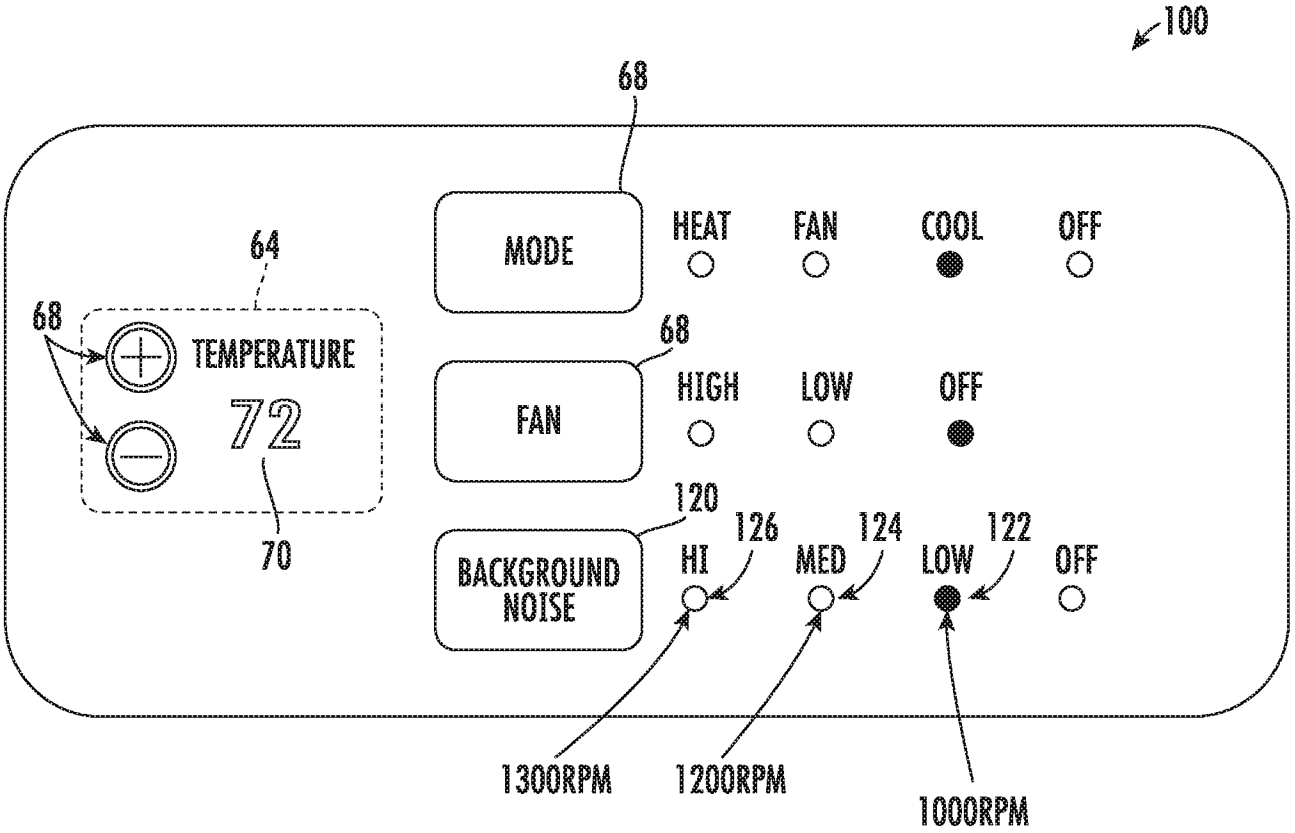
FIG. 7 is a front view of a control panel for use with the exemplary air conditioner unit of FIG. 1 according to an exemplary embodiment of the present subject matter.
Figure 8:
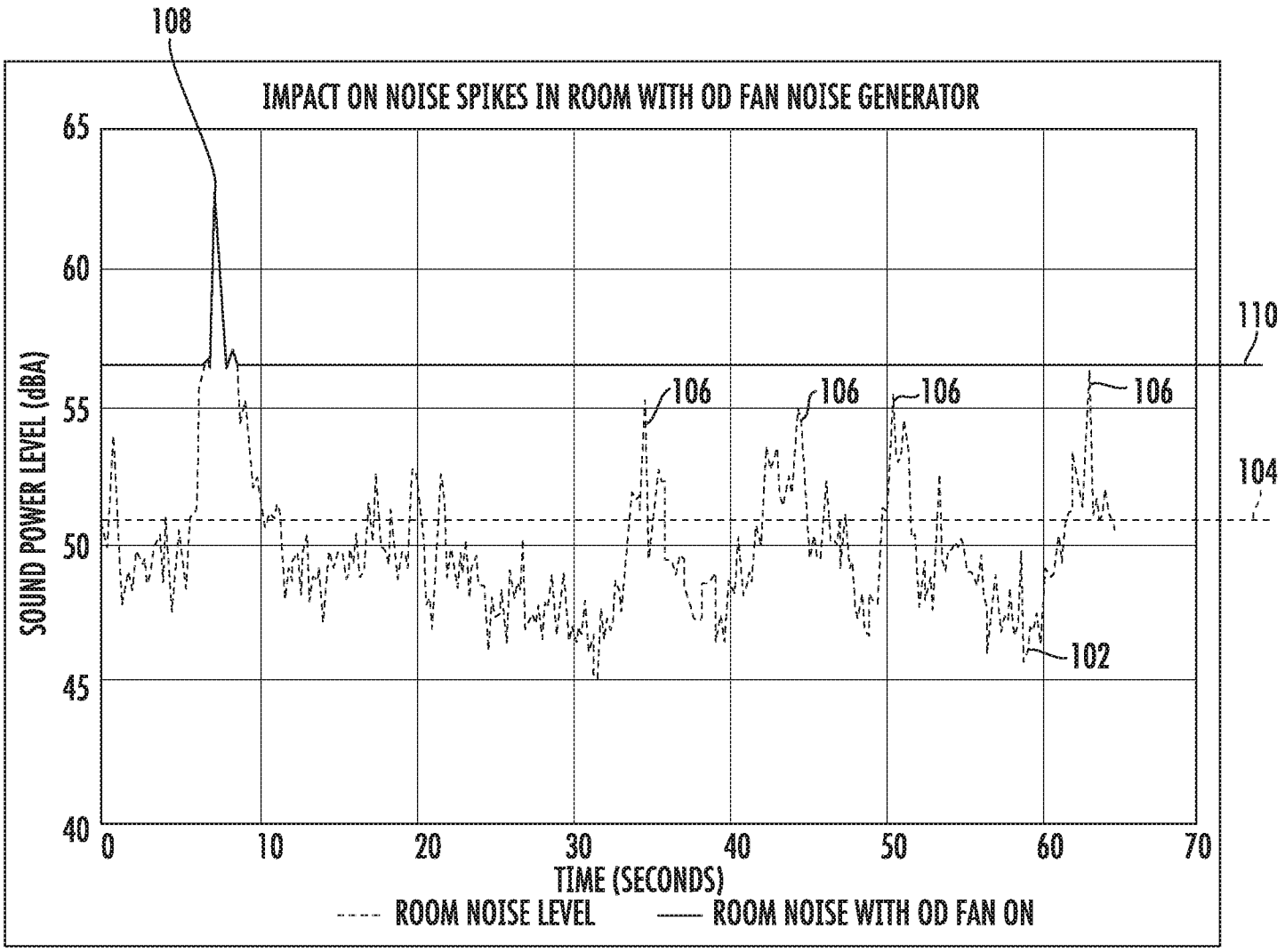
FIG. 8 is a plot of the sound level over an operating time of the exemplary air conditioner unit of FIG. 1 according to an exemplary embodiment of the present subject matter.
Figure 9:
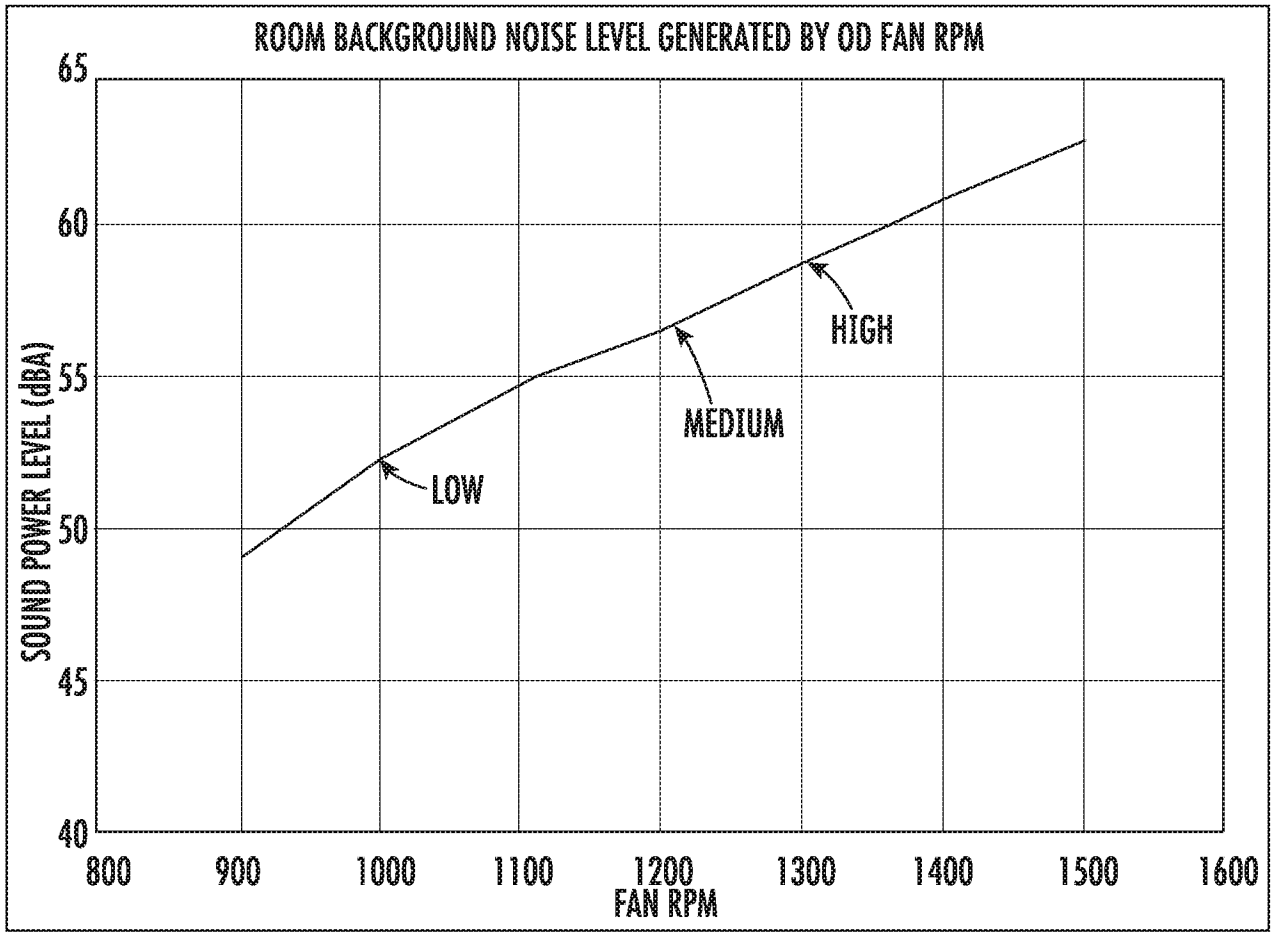
FIG. 9 is a plot showing the relationship of the sound output of an outdoor fan for a given fan speed according to an exemplary embodiment.

Referring now generally to FIGS. 7 through 10, aspects of the present subject matter are directed towards the use of a packaged terminal air conditioner unit, such as air conditioner unit 10, for generating white noise in certain situations or conditions. Specifically, FIG. 7 illustrates a control panel 100 that may be used to regulate the white noise generation of air conditioner unit 10 (e.g., similar to control panel 66). In addition, FIG. 8 provides a time plot of the sound power level within a hotel room over an exemplary time period and FIG. 9 provides the relationship between a fan speed (e.g., the speed of outdoor fan 32) to the sound power level output. Although exemplary configurations of control panel 100 and plotted sound relationships will be described herein and illustrated in the figures, it should be appreciated that these are only exemplary embodiments intended to facilitate explanation of aspects of the present subject matter. Thus, the present subject matter is in no way limited to the embodiments described.

As explained above, the air conditioner unit 10 may be positioned within a room of a hotel or other establishment that experience frequent noise spikes, disturbances, or other loud sounds. For example, noise emanating from sources such as traffic, voices of other occupants, airplanes, etc. may enter the room via the wall, through windows, and through the PTAC opening defined within the exterior wall. Notably, these noise variations or noise spikes may frequently disturb a room occupant. In this regard, sudden changes in the sound level can disrupt a person's personal comfort or focus, and spikes greater than 6 dB are considered to be a baseline for disrupting a person's sleep.

Aspects of the present subject matter are directed to systems and methods for generating white noise that mitigates the effect of noise spikes and variations on a room occupant. In this regard, by raising a nominal room noise level with white noise, large sounds may disturb room occupant less due to the decreased decibels spike relative to a situation where the nominal room noise level was not raised by white noise. As used herein, the term "white noise" is intended to refer to any sound or sounds that increase the nominal room noise level in a manner that makes loud sounds or noise spikes less disturbing to a room occupant. More specifically, according to exemplary embodiments, white noise may be a noise containing many frequencies with equal intensity, such as a noise that drowns out other sounds and/or may be more easily tuned out by a person's brain.

Specifically, referring now to FIG. 8, a noise power level 102 is plotted over an exemplary time period within an exemplary room. A nominal room noise level identified by reference numeral 104 represents an average noise level, in decibels, over the plotted time period. During this time period, several moderate noise spikes 106 occur, which may for example be defined as noise spikes that differ from the nominal room noise level 104 by between about 4-6 dB. In addition, one loud noise spike 108 occurs, which is illustrated as being a noise spike that differs from the nominal room noise level 104 by more than 10 dB. Notably, as explained above, without the benefit of white noise being generated, the moderate noise spikes 106 and particularly the loud noise spike 108 would disturb the room occupant, e.g., to the extent that they would wake up if sleeping.

However, as also shown in FIG. 8, the outdoor fan 32 may generate white noise according to an exemplary embodiment, such that the nominal room noise level reaches an elevated noise level 110. Notably, when white noise is being generated as shown in FIG. 8, moderate noise spikes 106 may not even be detected or noticeable by a room occupant because of the elevated noise level 110. The elevated noise level 110 from white noise is more pleasant and easier for a room occupant's brain to ignore than repeated moderate noise spikes 106. Moreover, even the loud noise spike 108 exceeds the elevated noise level 110 by only about 5 dB, which may be below a threshold that is likely to wait a room occupant who is sleeping. Therefore, as explained in more detail below, adjusting the rotational speed of outdoor fan 32 to adjust the elevated noise level 110 of generated white noise may improve the comfort of the room occupant. Specifically, as shown in FIG. 8, instead of multiple noise spikes in the 6-15 dB range, operating outdoor fan 32 to generate white noise eliminates noise spikes that exceed the general 5-6 decibels rule for disrupting a person's sleep.

Referring now to FIG. 9, the relationship between a speed of outdoor fan 32 and the sound power level of generated white noise is described according to an exemplary embodiment of the present subject matter. As shown, the speed of outdoor fan 32 may be adjusted depending on the desired sound power level of the white noise. For example, controller 64 may be operably coupled with outdoor fan 32 and may adjust the fan speed to achieve a variety of noise reduction objectives. For example, the fan speed may be adjusted to generate a user selected decibel level, to minimize the difference between loud noise spikes 108 and the nominal room noise level 104, or according to the user selected threshold levels (e.g., low, medium, or high).

A user may control the white noise level using control panel 100 which may be operably connected with controller 64. In this regard, for example, if a user selects a low white noise level (e.g., by pressing a button 120 until of a low status indicator 122 is illuminated), outdoor fan 32 may operate at approximately 1000 rpm to generate a sound power level of about 52-53 dB. By contrast, if a user selects a medium white noise level (e.g., by pressing button 120 until of a medium status indicator 124 is illuminated), outdoor fan 32 may operate at approximately 1200 rpm to generate a sound power level of about 56-57 dB, such as shown for example by elevated noise level 110 in FIG. 8. According to still other embodiments, a user may select a high noise level (e.g., by pressing button 120 until of a high status indicator 126 is illuminated), such that outdoor fan 32 is operated at approximately 1300 rpm to generate a sound power level of about 58-59 dB. It should be appreciated that other noise level thresholds and ways of controlling the white noise level may be used while remaining within the scope of the present subject matter.

Now that the construction of air conditioner unit 10 has been described according to exemplary embodiments, an exemplary method 200 of operating an outdoor fan of a packaged terminal air conditioner unit to generate white noise will be described. Although the discussion below refers to the exemplary method 200 of operating air conditioner unit 10, one skilled in the art will appreciate that the exemplary method 200 is applicable to the operation of a variety of other air conditioner units or fan assemblies.

Figure 10:
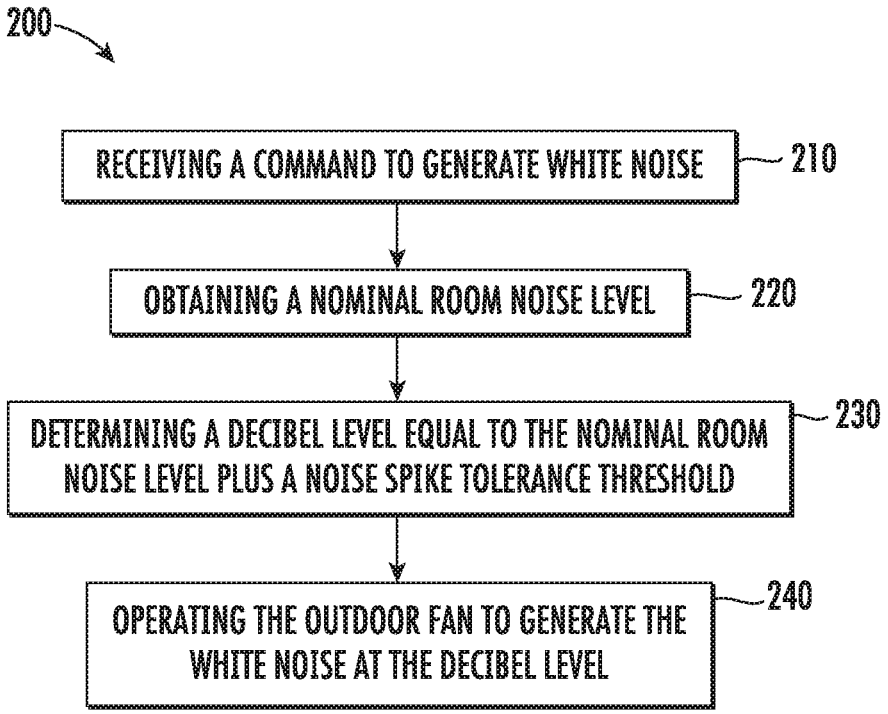
FIG. 10 is a method of generating white noise using an outdoor fan of an air conditioner unit according to an exemplary embodiment of the present subject matter.

Referring now to FIG. 10, method 200 includes, at step 210, receiving a command to generate white noise. For example, as explained above according to exemplary embodiments, the command to generate white noise may be initiated by a user or by controller 64. In addition, the command may include a desired noise level (e.g., in decibels), a desired fan speed, or a desired noise spike tolerance threshold. In this regard, the noise spike tolerance threshold may be the maximum desired noise spike relative to the nominal room noise level (e.g., the difference between the spike volume and the average volume).

According to the exemplary embodiment, after the noise spike tolerance threshold is selected, step 220 may include obtaining a nominal room noise level. In this regard, the nominal room noise level may be the average noise level (e.g., in decibels) over a predetermined duration of time. For example, a noise sensor may monitor the noise level within the room over 30 seconds or any other suitable time period, and the average decibel level over that time may represent the nominal room noise level. Then, if a user selects a specific noise spike tolerance threshold, such as the 6 dB, controller may determine the decibel level of white noise necessary to limit noise spikes to 6 dB relative to the nominal room noise level. In this regard, step 230 may include determining a decibel level equal to the nominal room noise level plus the noise spike tolerance threshold, e.g., 6 dB.

Step 240 includes operating the outdoor fan to generate white noise at the user selected or specified decibel level, or at the decibel level determined at step 230. In this manner, for example, controller 64 may regulate the speed of outdoor fan 32 at an RPM necessary (e.g., based on the relationship from FIG. 9) to generate the desired decibel level of white noise. Although the noise spike tolerance threshold is described herein as being 6 dB, it should be appreciated that this value may vary, e.g., depending on user preference, ambient noise levels, etc. For example, according to alternative embodiments, the noise spike tolerance threshold may be between about 2 and 20 dB, between about 5 and 15 dB, etc.

In addition, according to exemplary embodiments, it should be appreciated that controller 64 may operate outdoor fan to generate white noise only if air conditioner unit 10 is not actively heating or cooling the room in which is installed. In this regard, for example, if compressor 34 is circulating the refrigerant, outdoor fan 32 may preferably be operated to facilitate the heating or cooling process being performed by the sealed system. In such an embodiment, controller 64 will operate air conditioner unit as normal until the heating or cooling cycle is completed, at which time the white noise generation may proceed as specified by the user.

FIG. 10 depicts steps performed in a particular order for purposes of illustration and discussion. Those of ordinary skill in the art, using the disclosures provided herein, will understand that the steps of any of the methods discussed herein can be adapted, rearranged, expanded, omitted, or modified in various ways without deviating from the scope of the present disclosure. Moreover, although aspects of method 200 are explained using air conditioner unit 10 as an example, it should be appreciated that these methods may be applied to the operation of any air conditioner unit or fan assembly having any other suitable configuration.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An air conditioner unit, comprising:
- a bulkhead defining an indoor portion and an outdoor portion;
- an outdoor fan positioned within the outdoor portion for urging a flow of air through the outdoor portion; and
- a controller communicatively coupled with the outdoor fan, the controller configured for:
  - receiving a command to generate white noise;
  - obtaining a nominal room noise level; and
  - operating the outdoor fan to generate the white noise at a decibel level equal to the nominal room noise level plus a noise spike tolerance threshold.

2. The air conditioner unit of claim 1, wherein the outdoor fan is a variable speed fan and wherein operating the outdoor fan to generate the white noise comprises:
- adjusting a speed of the outdoor fan to regulate a decibel level of the white noise.

3. The air conditioner unit of claim 1, wherein receiving the command to generate the white noise comprises:
- receiving a command to operate the outdoor fan in a high noise mode, a medium noise mode, or a low noise mode of operation.

4. The air conditioner unit of claim 3, wherein the outdoor fan rotates at 1300 RPM in the high noise mode, at 1200 RPM in the medium noise mode, and at 1000 RPM in the low noise mode.

5. The air conditioner unit of claim 1, wherein the noise spike tolerance threshold is between about 5 and 15 decibels.

6. The air conditioner unit of claim 1, wherein the noise spike tolerance threshold is about 6 decibels.

7. The air conditioner unit of claim 1, wherein receiving the command to generate the white noise comprises:
- receiving a command to operate the outdoor fan to generate the white noise at a user selected decibel level.

8. The air conditioner unit of claim 1, wherein a user generates the command to generate the white noise using a user interface panel.

9. The air conditioner unit of claim 8, wherein the user interface panel has a high noise button, a medium noise button, and a low noise button.

10. A method of generating white noise using a packaged terminal air conditioner unit, the method comprising:
- receiving a command to generate the white noise;
- obtaining a nominal room noise level; and
- operating the outdoor fan to generate the white noise at a decibel level equal to the nominal room noise level plus a noise spike tolerance threshold.

11. The method of claim 10, wherein the outdoor fan is a variable speed fan and wherein operating the outdoor fan to generate the white noise comprises:
- adjusting a speed of the outdoor fan to regulate a decibel level of the white noise.

12. The method of claim 10, wherein receiving the command to generate the white noise comprises:
- receiving a command to operate the outdoor fan in a high noise mode, a medium noise mode, or a low noise mode of operation.

13. The method of claim 12, wherein the outdoor fan rotates at 1300 RPM in the high noise mode, at 1200 RPM in the medium noise mode, and at 1000 RPM in the low noise mode.

14. The method of claim 10, wherein the noise spike tolerance threshold is between about 6 decibels.

15. The method of claim 10, wherein receiving the command to generate the white noise comprises:
- receiving a command to operate the outdoor fan to generate the white noise at a user selected decibel level.

16. The method of claim 10, wherein a user generates the command to generate the white noise using a user interface panel.

17. An air conditioner unit, comprising:
- a bulkhead defining an indoor portion and an outdoor portion;
- an outdoor fan positioned within the outdoor portion for urging a flow of air through the outdoor portion; and
- a controller communicatively coupled with the outdoor fan, the controller configured for:
  - receiving a command to generate white noise;
  - obtaining a nominal room noise level; and
  - operating the outdoor fan to generate the white noise at a decibel level equal to the nominal room noise level plus a noise spike tolerance threshold.

18. The air conditioner unit of claim 17, wherein the outdoor fan is a variable speed fan and wherein operating the outdoor fan to generate the white noise comprises:
- adjusting a speed of the outdoor fan to regulate a decibel level of the white noise.

* * * * *